US007621374B2

(12) United States Patent
Richey

(10) Patent No.: US 7,621,374 B2
(45) Date of Patent: Nov. 24, 2009

(54) SECTIONAL OVERHEAD LADDER WITH A FOLD ASSIST FEATURE

(75) Inventor: Steven M. Richey, Morristown, TN (US)

(73) Assignee: Precision Ladders, LLC, Morristown, TN (US)

( * ) Notice: Subject to any disclaimer, the term of this patent is extended or adjusted under 35 U.S.C. 154(b) by 573 days.

(21) Appl. No.: 11/201,029

(22) Filed: Aug. 10, 2005

(65) Prior Publication Data

US 2007/0034450 A1 Feb. 15, 2007

(51) Int. Cl.
*E06C 9/00* (2006.01)

(52) U.S. Cl. ..... 182/77; 182/81

(58) Field of Classification Search ..... 182/77–81
See application file for complete search history.

(56) References Cited

U.S. PATENT DOCUMENTS 1,811,708 A * 6/1931 Bessler ..... 182/78
4,014,486 A * 3/1977 Nelson et al. ..... 244/129.6
4,180,142 A * 12/1979 Sevillano et al. ..... 182/77
4,541,508 A * 9/1985 Lundh ..... 182/78
5,239,795 A * 8/1993 Breaux ..... 52/182
5,407,261 A 4/1995 Mercer
5,454,196 A 10/1995 Gaines et al.
5,595,028 A 1/1997 Handzlik
5,842,313 A 12/1998 Murray et al.
5,911,661 A 6/1999 Murray et al.
6,213,486 B1 4/2001 Kunz et al.
6,354,382 B1 3/2002 Jarman et al.
6,357,842 B1 3/2002 Nott et al.
6,401,861 B1 6/2002 Marszalek
6,442,796 B2 * 9/2002 Arisaka et al. ..... 16/84
6,578,833 B2 * 6/2003 Arisaka ..... 267/71
6,662,901 B1 * 12/2003 Appl ..... 182/77
6,698,548 B1 * 3/2004 Verrill ..... 182/129
6,866,118 B1 * 3/2005 Battenberg ..... 182/77
7,367,086 B2 * 5/2008 Ito ..... 16/85

* cited by examiner

*Primary Examiner*—Katherine Mitchell
*Assistant Examiner*—Candace L. Bradford
(74) *Attorney, Agent, or Firm*—Pitts & Brittian, PC

(57) ABSTRACT

A sectional overhead ladder with a fold assist feature for controlling the extension of the sectional overhead ladder. The fold assist feature of the sectional overhead ladder limits the possibility of free extension of the extendable overhead ladder by preventing gravitational forces from causing the ladder sections to fall into their extended configuration. The sectional overhead ladder includes generally a stair structure and an extendable dampening system. The extendable dampening system is comprised of a dampener and, optionally, a housing. The stair structure includes a first section and a second section. The dampening system is attached to the first and second sections of the stair structure such that the dampener limits the free extension of the stair structure and assists with the collapse of the stair structure.

9 Claims, 6 Drawing Sheets

SECTIONAL OVERHEAD LADDER WITH A FOLD ASSIST FEATURE

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to overhead ladders. More particularly, this invention pertains to a force-dampening system used in conjunction with an sectional overhead ladder such that when the ladder is collapsed, the force-dampening system limits the free extension of the ladder and when the ladder is extended, the force-dampening system assists with the collapse of the ladder.

2. Description of the Related Art

Overhead ladders are commonly used to provide convenient, temporary access to attics of houses or other structures without the loss of floor space occupied by a permanent stairwell. Typically, overhead ladders include a plurality of sections that are folded upon one another within a frame secured to a structure. The ladder typically includes hinges for connecting the sections. The sections of the ladder align during use to form a continuous ladder structure spanning from one surface to another.

An overhead ladder is typically accessible from beneath by way of a hatch mounted in the ceiling. Most commonly, a user must access such an overhead ladder by pulling down the ceiling-mounted hatch and manually extending the sections of the ladder. However, the sections of an overhead ladder are often heavy and cumbersome, and a user manually extending an extendable ladder faces a risk of injury caused by the sudden extension of the ladder due to the force of gravity acting on the ladder sections. FIG. 2 illustrates a typical overhead attic ladder constructed for being folded prior to storage. In this figure, it is more clearly illustrated that the various ladder sections are capable of free extension about their hinged joints.

Several devices have been developed to overcome these and similar problems associated with temporary ladders and other similar devices. Typical of the art are those devices disclosed in the following U.S. Patents:

| Patent No. | Inventor(s) | Issue Date |
|---|---|---|
| 1,811,708 | F. E. Bessler | Oct. 27, 1928 |
| 6,354,682 | Bruce E. Nott, et al | Mar. 12, 2002 |

Of these patents, U.S. Pat. No. 1,811,708 (the '708 patent) discloses a foldable attic ladder that utilizes an electric motor to lower and raise the ladder. The '708 patent discloses a hinged panel capable of connecting to a ceiling, a foldable stair structure, and an electric motor. The foldable stair structure includes one section mounted on top of the panel and two folding sections hinged together and to the first section. The panel and the sections of the foldable stair structure are held by a plurality of supporting members. The supporting arms and the electric motor are connected to a rotating shaft in such a manner that when the electric motor is engaged, the rotating shaft actuates the supporting members which in turn lower the panel and extend the foldable stair structure.

U.S. Pat. No. 6,354,682, (the '682 patent) issued to Bruce E. Nott, et al., discloses an overhead storage device. The '682 patent discloses a storage container pivotally connected to a frame adapted to be connected to an overhead surface. A motorized actuator is connected to the storage container and is capable of controllably pivoting the storage container relative to the frame such that the reference plane moves between a generally horizontal position and a generally vertical position.

BRIEF SUMMARY OF THE INVENTION

The present invention is a sectional overhead ladder including a fold assist feature for controlling the extension of the sectional overhead ladder. The ladder of the present invention provides a convenient temporary ladder adapted to be installed in a ceiling entranceway or other structure. The fold assist feature of the sectional overhead ladder limits the possibility of free extension of the extendable overhead ladder by preventing gravitational forces from causing the ladder sections to fall into their extended configuration. The sectional ladder includes generally a collapsible ladder and an extendable dampening system. The extendable dampening system is carried by the ladder.

According to one embodiment of the present invention, the sectional ladder defines a foldable overhead or attic ladder adapted to be mounted in a ceiling entranceway. The foldable attic ladder includes a support frame mounted in the ceiling entranceway and a hatch pivotally connected to the frame by a hinge. The hatch is held by a plurality of supporting members. A foldable stair structure of the foldable attic ladder includes one section mounted on top of the panel and two folding sections hinged together and to the first section. The ladder sections comprise a pair of side rails connected at substantially right angles by a plurality of rungs. The several sections of the foldable stair structure are pivotally connected end to end such that when extended, the sections form a continuous ladder from one surface to another.

A first end of the extendable dampening system is pivotally attached to a first side rail of the first ladder section and a second end of the extendable dampening system is pivotally attached to the cooperating first side rail of the second ladder section. The extendable dampening system comprises a dampener and a housing having a first member and a second member which comprise telescoping tubes that receive the dampening member. In the illustrated embodiment, the housing defines a substantially tubular configuration, and the first member of the housing is adapted to fit telescopically inside the second member.

The dampener is adapted to fit within the housing. The dampener comprises a member having a first end and a second end and is capable of extending in response to a tensile force exerted on the first and second ends and returning to its original form when the tensile force is released.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

A sectional overhead ladder including a fold assist feature for controlling the extension of the sectional ladder is disclosed. The sectional overhead ladder of the present invention, illustrated at 10 in the figures, provides a convenient temporary ladder adapted to be installed in a ceiling entranceway or other structure. The fold assist feature of the sectional overhead ladder limits the possibility of free extension of the extendable overhead ladder by preventing gravitational forces from causing the ladder sections to fall into their extended configuration during extension. Furthermore, the fold assist feature limits the possibility of collapse of the extendable overhead ladder by helping to secure the ladder sections in their extended position.

Figure 1:
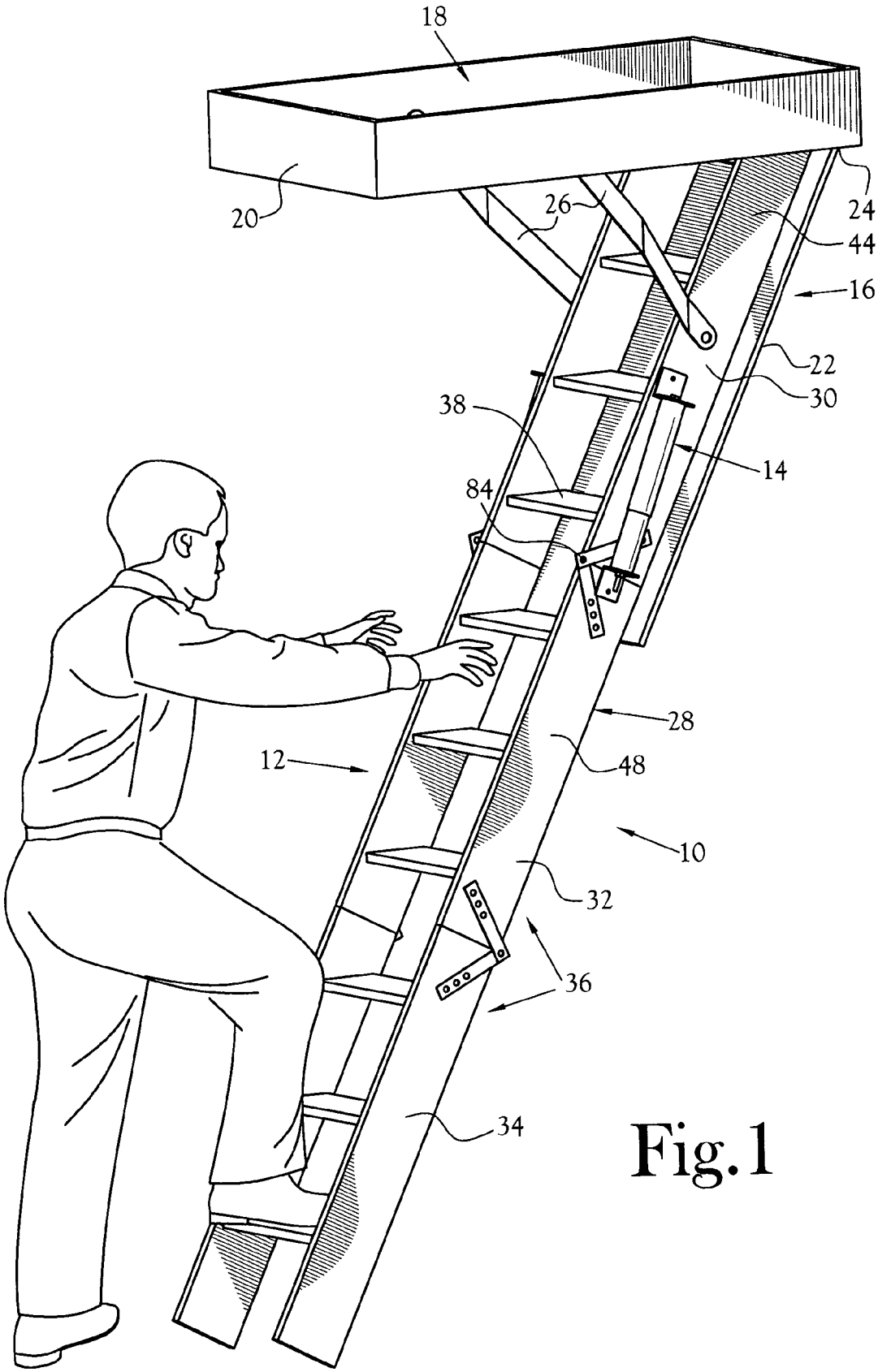
FIG. 1 is a perspective view of one embodiment of a sectional ladder constructed in accordance with several features of the present invention, showing an extendable ladder in its extended position with a user climbing the extendable ladder.
Figure 2:
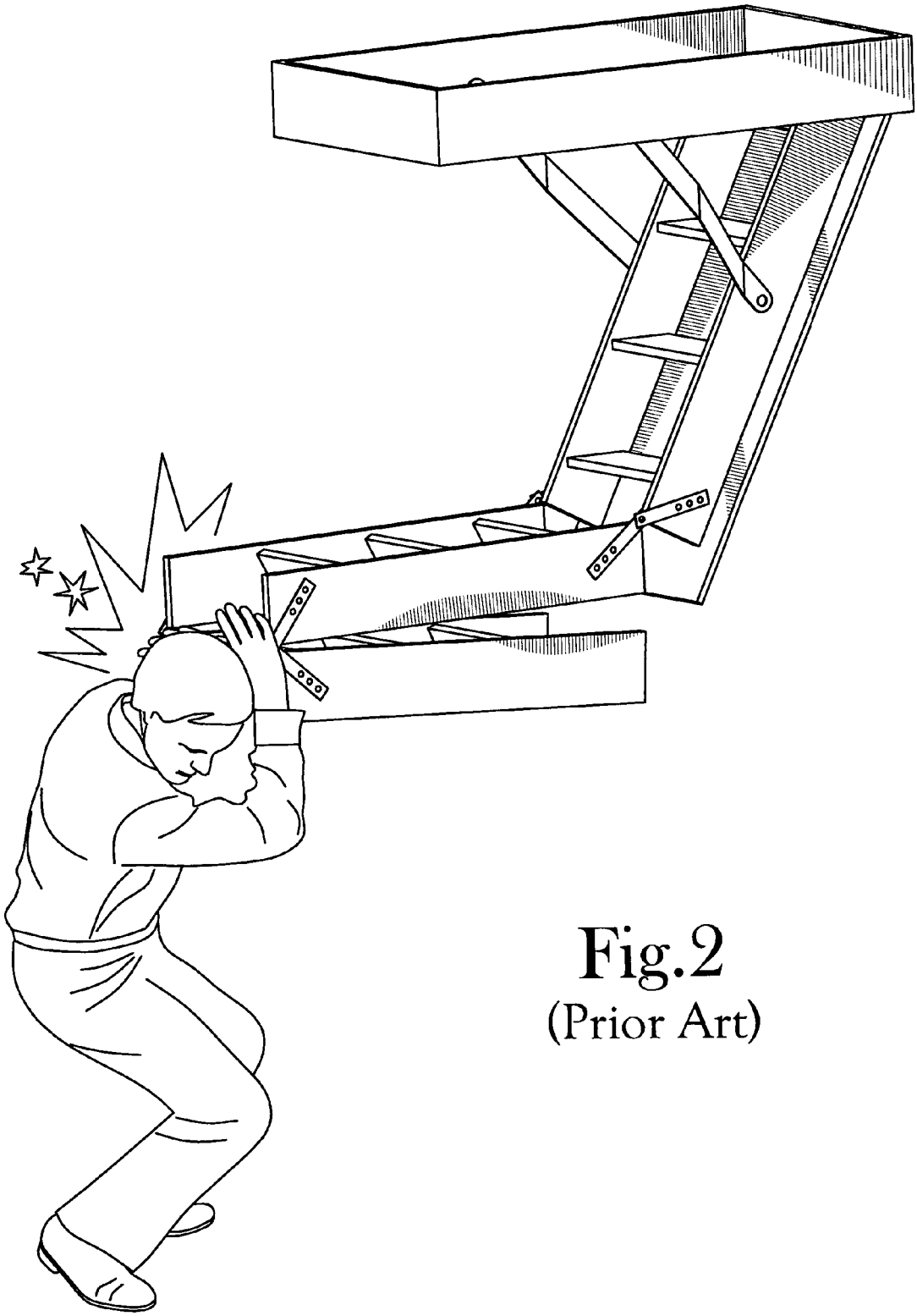
Fig.2 (Prior Art)
FIG. 2 is a perspective view of a prior art foldable attic ladder.

FIG. 1 is a perspective view of one embodiment of a sectional overhead ladder 10 constructed in accordance with several features of the present invention. The sectional overhead ladder 10 includes generally a collapsible ladder 12 and an extendable dampening system 14. The sectional overhead ladder 10 is typically adapted to be mounted on a pre-existing structure. In the illustrated embodiment, the sectional overhead ladder defines a foldable attic ladder 16 adapted to be mounted in a ceiling entranceway 18. The foldable attic ladder includes a support frame 20 mounted in the ceiling entranceway and a hatch 22 pivotally connected to the frame by a hinge 24. The hatch is held by a plurality of supporting members 26. However, it will be understood that the sectional overhead ladder may be adapted to be mounted on other conventional structures without departing from the spirit and scope of the present invention.

The foldable attic ladder 16 includes a foldable stair structure 28. The foldable stair structure 28 has one section 30 mounted on top of the hatch 22 and two folding sections 32, 34 collapsably connected together and to the first section 30. The several sections of the foldable stair structure 28 are collapsably connected end to end such that when extended, the sections form a continuous ladder from one surface to another. The ladder sections comprise a pair of side rails 36 connected at substantially right angles by a plurality of rungs 38. In the illustrated embodiment, the several sections of the foldable stair structure 28 are pivotally connected in and end to end configuration. The side rails 36 of a first ladder section are adapted to be mounted on the top of the hatch 22 such that the side rails 36 and the frame 20 define a void 40.

The extendable dampening system 14 of the present invention is carried by the collapsible ladder 12. The extendable dampening system 14 is adapted to be received within the void 40 between the frame 20 and the side rails 36. A first end of the extendable dampening system 42 is pivotally attached to a first side rail 44 of the first ladder section and a second end of the extendable dampening system 46 is pivotally attached to the cooperating first side rail 48 of the second ladder section. The extendable dampening system 14 of the present invention is further adapted to be installed on an existing collapsible ladder to accomplish the present invention.

Figure 3:
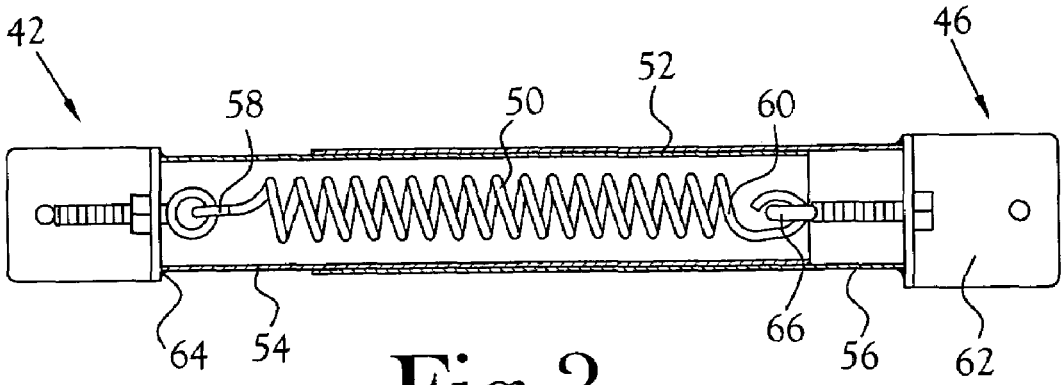
FIG. 3 is a top plan view, in section, of one embodiment of the dampening system portion of the sectional ladder of the present invention.

As illustrated in FIG. 3, one embodiment of the invention includes an extendable dampening system 14 comprising a dampener 50 and a housing 52 having a first member 54 and a second member 56. In the illustrated embodiment, the housing 52 defines a substantially tubular configuration, and the first member of the housing 54 is adapted to fit telescopically inside the second member 56. The dampener 50 is adapted to fit within the housing 52. The dampener 50 comprises a member having a first end 58 and a second end 60 and is capable of extending in response to a tensile force and returning to its original form when the tensile force is released. The illustrated embodiment utilizes a spring-actuated dampener 50. However, it will be understood that a pneumatic piston, a hydraulic piston, or other conventional devices can be used without departing from the spirit and scope of the present invention.

Figure 4:
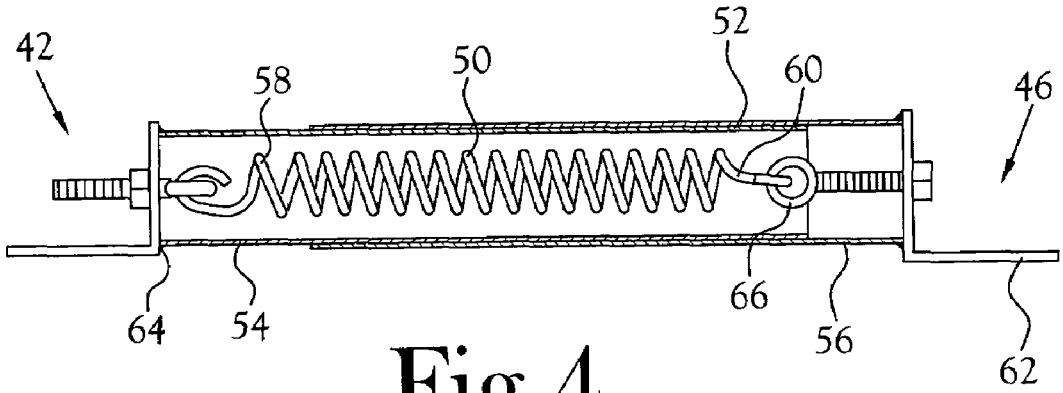
FIG. 4 is a side elevation view, in section, of one embodiment of the dampening system portion of the sectional ladder of the present invention.

In the illustrated embodiment, a pair of angle brackets 62 is provided to secure the dampener 50 to the first and second ladder sections 30, 32. Referring to FIG. 4, the angle brackets 62 are connected to the ends of the housing 52 using a suitable fastener, such as a weld 64 or integral connection. The dampener 50 is also connected to the angle brackets 62 by a suitable fastener 66. The angle brackets 62 pivotally connect the ends of the dampener 58, 60 and the housing 52 to the side rails of the first ladder section and the second ladder section 44, 48, respectively, by a nut and bolt assembly 68 or other suitable pivotal fastening means. This configuration allows the dampener to define an extendable tension member 72 spanning between the pivoting connections of the first and second ladder sections.

In the illustrated embodiment, the dampener 50 is encased entirely by the housing 52. Specifically, this limits access to the dampener and reduces the possibility of damage to the dampener or to any material which might otherwise contact the dampener during use of the sectional overhead ladder. Additionally, complete encasement of the dampener in the housing significantly reduces the possibility of injury to the user through contact with the expanding or collapsing dampener. However, those skilled in the art will recognize that the dampener can be adapted to fit only partially within the housing without departing from the spirit and scope of the present invention. To this extent, inclusion of the housing 52 in the dampening system 14 is not necessary to accomplish the present invention.

Figure 6:
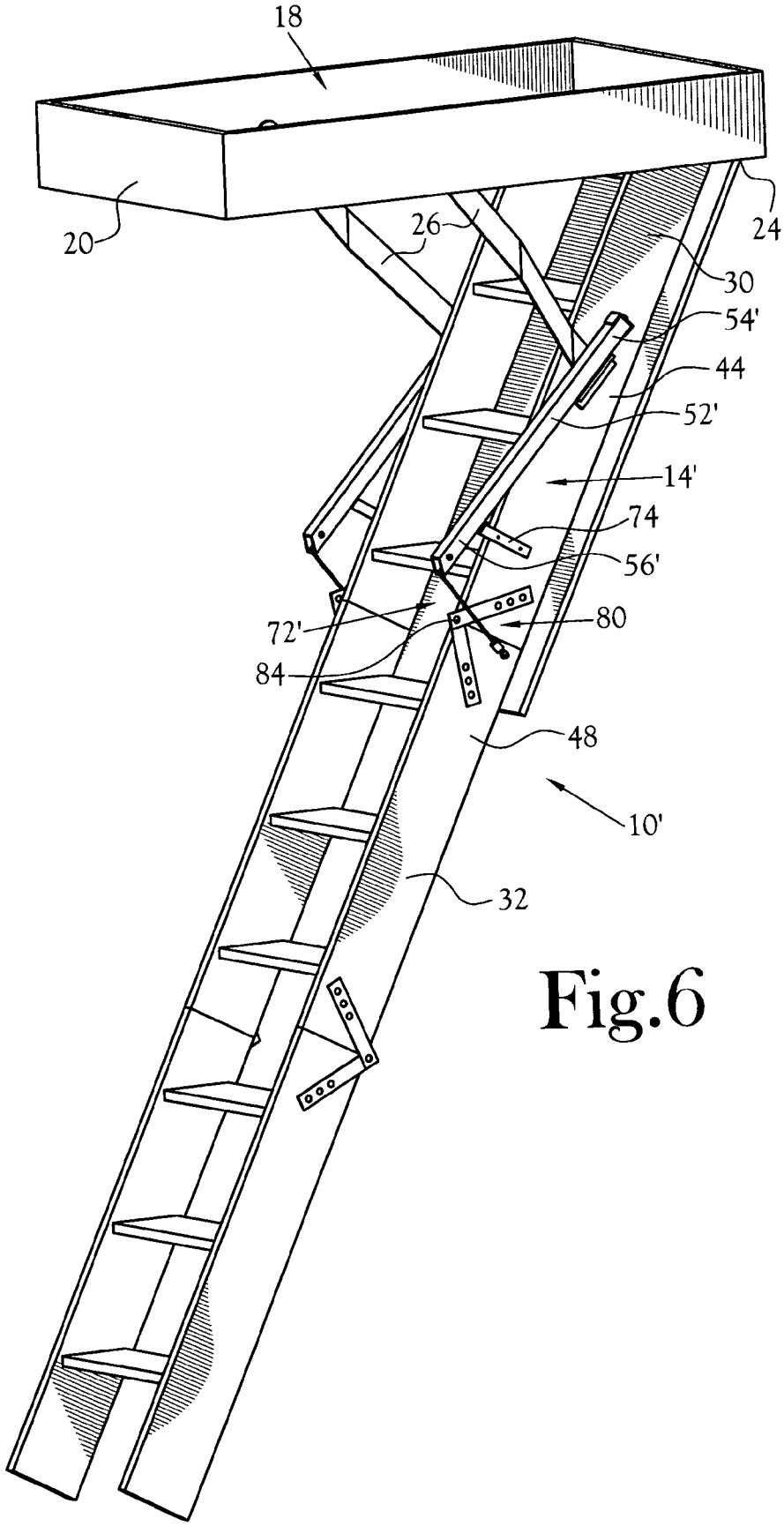
FIG. 6 is a perspective view of an alternate embodiment of a sectional ladder constructed in accordance with several features of the present invention.
Figure 7:
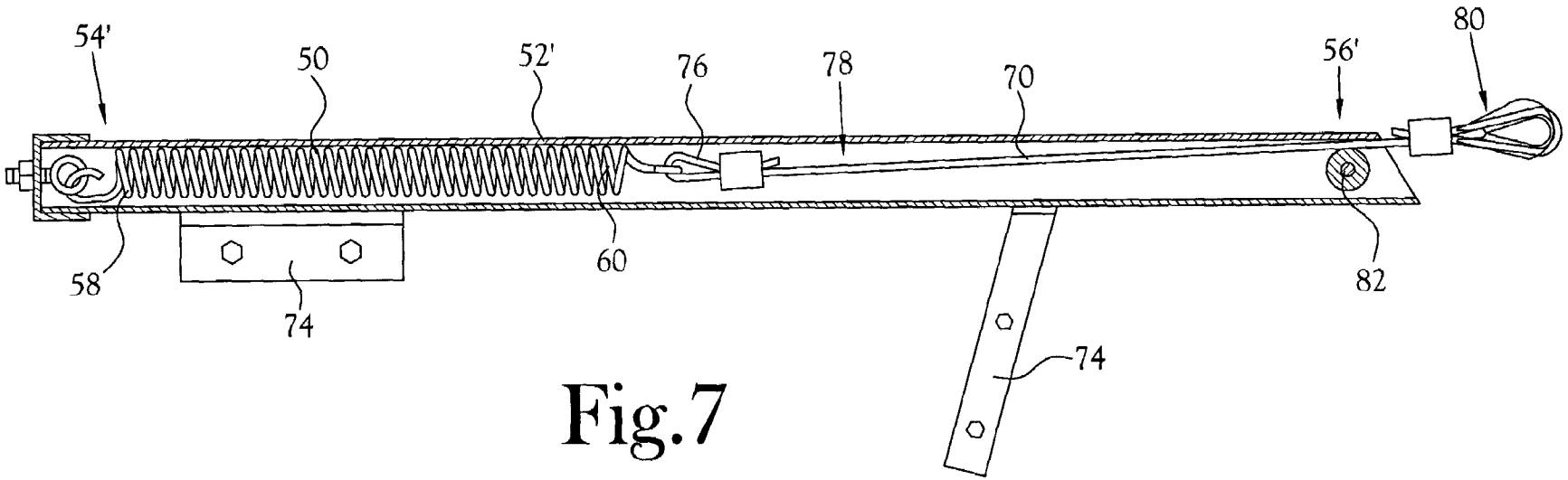
FIG. 7 is a side elevation view, in section, of the dampening system portion of the sectional ladder of FIG. 6.

An alternate embodiment of the sectional overhead ladder of the present invention is illustrated at 10' in FIGS. 6 and 7. Referring to FIG. 7, the extendable dampening system 14' comprises a cord 70 and a dampener 50. The dampener 50 is substantially surrounded by a housing 52'. The housing 52' comprises a single substantially tubular member fixably attached to the second ladder section 32. In this embodiment, the first end of the housing 52' is offset from the first ladder section 30. The extendable tension member 72' is defined by the cord 70 spanning between the first end of the housing 54' and the second ladder section 32.

In the illustrated alternate embodiment shown in FIG. 6, the housing 52' is fixably attached to the first ladder section 30 using suitable fasteners, such as angle brackets 74, so that the length or longitudinal dimension of the housing 52 extends at an angle from or is canted in a substantially non-parallel fashion to the linear dimension of the first side rail of the first ladder section 44. However, it will be understood that the canting of the housing to the ladder section first side rail is not required to accomplish the present invention.

A first end of the dampener 58 is connected to a first end of the cord 78 by a suitable fastener. A second end of the dampener 60 is connected to a first end of the housing 54' such that the dampener 50 is substantially surrounded by the housing 52. As shown in FIG. 6, a second end of the cord 80 is pivotally attached to the first side rail of the second ladder section 48.

A second end of the housing 56' defines an opening and includes a pivoting guide 82 such as a roller or other suitable pivoting guide. The pivoting guide 82 receives the cord 70 and allows the cord, as the dampener 50 extends and retracts, to extend at an angle canted to the length or longitudinal dimension of the housing 52'. This configuration allows the cord 70 to define an extendable tension member 72' spanning from the pivoting guide 82 of the second end of the housing to the pivotal connection between the cord 70 and the first ladder section 32.

In the depicted embodiment, one dampening system 14 is utilized in the sectional overhead ladder 10 of the present invention. It will be recognized that a plurality of dampening systems can be utilized to control a plurality of collapsably attached foldable sectional overhead ladder sections, or multiple dampening systems can control a single collapsible ladder section joint.

Figures 5A, 5B, 5C:
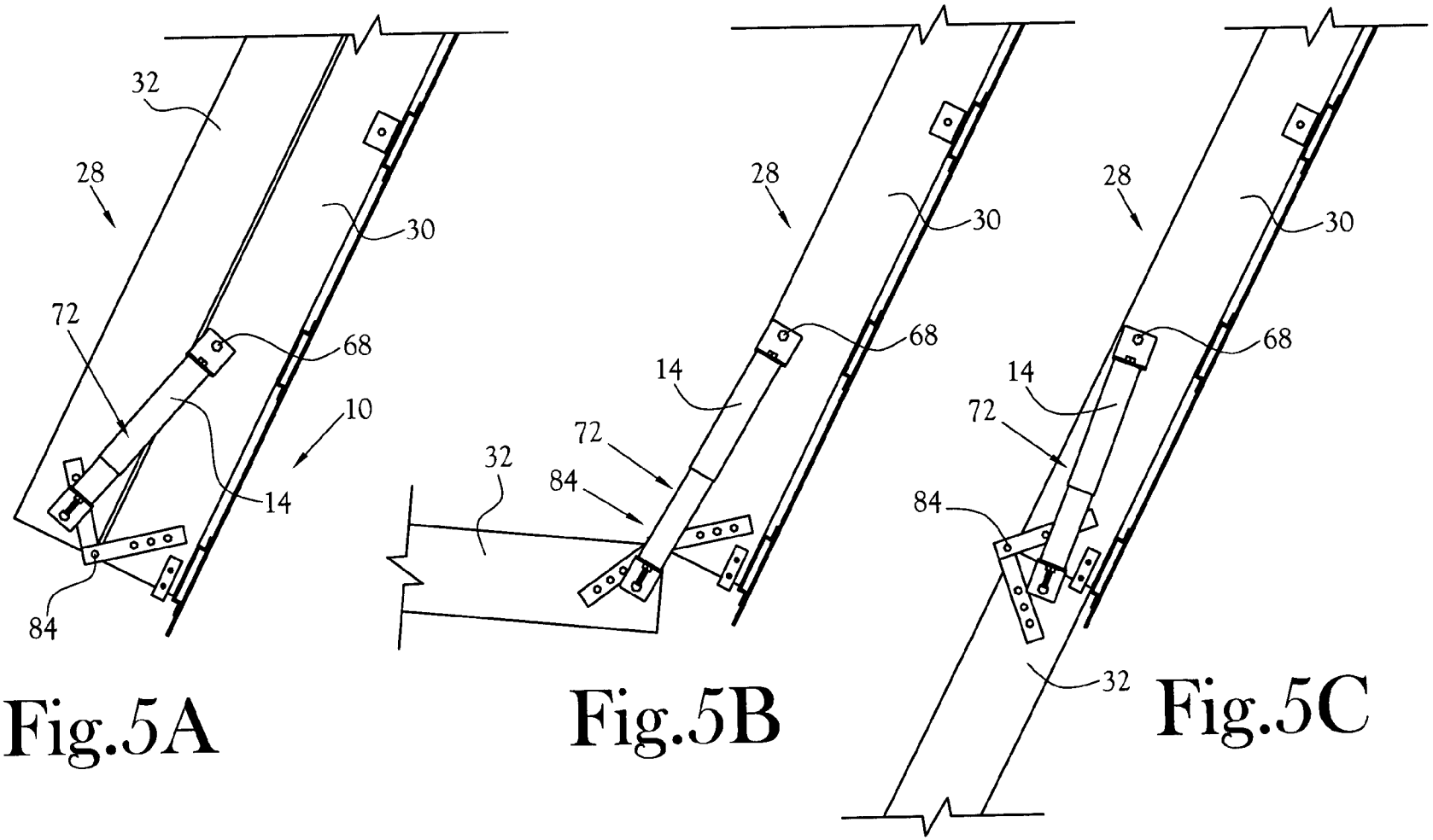
FIG. 5A is a side elevation view of the sectional ladder of FIG. 1, showing the sectional ladder in the folded position.
FIG. 5B is a side elevation view of the sectional ladder of FIG. 1, showing the sectional ladder partially extended to show the position of maximum extension of the dampening system.
FIG. 5C is a side elevation view of the sectional ladder of FIG. 1, showing the sectional ladder in the extended position.

FIGS. 5A-5C better illustrate the relative movement permitted between the extendable tension member 72 and the foldable stair structure 28. FIG. 5A shows the sectional overhead ladder 10 of the present invention with the foldable stair structure 28 in the collapsed position. In this embodiment, the two ladder sections 30, 32 are configured so as to allow the connected ladder sections to pivot about a hinge 84 offset from the extendable tension member 72. The ends of the extendable dampening system are secured to the first and second ladder sections such that when a moment is applied about the hinge 84 connecting the first and second ladder sections, the extendable tension member exerts a tensile or pulling force and resists the free extension of the ladder sections.

As the ladder sections 30, 32, 34 are manually rotated and the foldable stair structure 28 extended, the distance between the hinge 84 and the extendable tension member 72 becomes decreased. As shown in FIG. 5B, the pivot point of the hinge 84 aligns with the axis of the extendable tension member 72 during extension, and at approximately this point the tensile force provided by the extendable tension member 72 neither resists nor encourages free extension of the sectional overhead ladder 10. As shown in FIG. 5C, as the sectional overhead ladder 10 is rotated beyond the point of alignment and into its extended position, the pivot point of the hinge 84 between the ladder sections offsets from the extendable tension member 72, such that the tensile force provided by the extendable tension member 72 helps the sectional overhead ladder 10 to complete extension. This configuration of the extendable dampening system 14 to the foldable stair structure 28 allows the sectional overhead ladder 10 of the present invention to remain securely in its extended position during use and to remain securely in its collapsed position during storage.

From the foregoing description, it will be recognized by those skilled in the art that several embodiments of a sectional overhead ladder of the present invention have been provided. The sectional overhead ladder of the present invention provides a convenient temporary ladder adapted to be installed in a ceiling entranceway or other structure. The sectional overhead ladder limits the danger associated with the gravitational forces involved in manually extending an extendable ladder.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to specific details, representative apparatus and methods, and illustrative examples shown and described. Accordingly, departures may be made from such details without departing from the spirit or scope of applicant's general inventive concept.

What is claimed is:

1. A sectional overhead ladder comprising:

a stair structure defining at least a first section and a second section, said first section and said second section being collapsably connected such that said stair structure is collapsed for storage and extended for use, a dampening system comprising, a housing having a first end and a second end, said housing first end being attached to said first section of said stair structure;

a dampener substantially encased within said housing, said dampener defining a first end and a second end, said dampener first end being attached to said housing first end, and;

a cord defining a first end and a second end, said first end of said cord being attached to said second end of said dampener, said second end of said cord being attached to said second section of said stair structure, whereby when said stair structure is collapsed, said dampener and said cord limit the free extension of said stair structure and when said stair structure is extended, said dampener and said cord limit the collapse of said stair structure.

2. The sectional overhead ladder of claim 1, said stair structure defining at least a first section and a second section, said first section and said second section being pivotally connected such that said second section rotates proximate said first section to extend for use and to collapse for storage.

3. The sectional overhead ladder of claim 1, said first end of said housing being fixably connected to said first section of said stair structure and said second end of said cord being pivotally connected to said second section of said stair structure.

4. The sectional overhead ladder of claim 1, wherein:

said first end of said dampener is fixably connected to said first section of said housing; and, said housing is fixably connected to said first section of said stair structure.

5. The sectional overhead ladder of claim 1, wherein:

said first end of said dampener is fixably connected to said first section of said housing; and, said housing is fixably connected to said first section of said stair structure such that a longitudinal dimension of said housing extends at an angle substantially canted to a linear dimension of said first section of said stair structure.

6. The sectional overhead ladder of claim 1, said sectional overhead ladder further comprising:

a pivoting guide proximate said second end of said housing, said pivoting guide being adapted to receive said cord and to allow said cord, as said dampener extends and retracts, to extend at an angle substantially canted to a longitudinal dimension of said housing.

7. The sectional overhead ladder of claim 1, said sectional overhead ladder further comprising:

a pivoting guide proximate said second end of said housing, said pivoting guide being adapted to receive said cord and to allow said cord, as said dampener extends and retracts, to extend at an angle canted to a longitudinal dimension of said housing;

whereby said stair structure defines at least a first section and a second section, said first section and said second section being pivotally connected such that said second section rotates proximate said first section to extend for use and to collapse for storage; and, whereby said first end of said dampener is fixably connected to said housing, said housing is fixably connected to said first section of said stair structure such that said longitudinal dimension of said housing is substantially canted to a linear dimension of said first section of said stair structure, and said second end of said cord is pivotally connected to said second section of said stair structure.

8. An improved sectional overhead ladder of the type wherein said sectional overhead ladder defines a stair structure having at least a first ladder and a second ladder, the first ladder of the stair structure and the second ladder of the stair structure being pivotally connected in such a manner that they are rotated about a pivotal connection from a folded position into an extended position, the improvement comprising a dampening system having a first end and a second end, said first end being adapted to be attached to the first ladder and said second end being adapted to be attached to the second ladder, said dampening system comprising, a housing defining a first end and a second end, said first end of said housing being adapted to be attached to the first ladder;

a dampener substantially encased in said housing, said dampener defining a first end and a second end, said first end of said housing being attached to said first end of said dampener; and being adapted to be attached to the first ladder and said second end being adapted to be attached to the second ladder, whereby when the first ladder and the second ladder are rotated about the pivotal connection, the dampener limits the rotation of the first ladder proximate the second ladder;

a cord defining a first end and a second end, said first end of said cord being attached to said second end of said dampener, said second end of said cord being adapted to be attached to the second ladder such that when the stair structure is collapsed, said dampener and said cord limit free extension of said stair structure and when the stair structure is extended, said dampener and said cord limit the collapse of the stair structure; whereby when the first ladder and the second ladder are rotated about the pivotal connection, the dampener limits the rotation of the first ladder proximate the second ladder.

9. An improved sectional overhead ladder of the type wherein said sectional overhead ladder defines a stair structure having at least a first ladder and a second ladder, the first ladder of the stair structure and the second ladder of the stair structure being pivotally connected in such a manner that they are rotated about a pivotal connection from a folded position into an extended position, the improvement comprising a dampening system having a first end and a second end, said first end being adapted to be attached to the first ladder and said second end being adapted to be attached to the second ladder, said dampening system comprising, a housing defining a first end and a second end, said first end of said housing being fixably connected to said first ladder such that said longitudinal dimension of said housing is substantially canted to a linear dimension of said first ladder;

a dampener substantially encased in said housing, said dampener defining a first end and a second end, said first end of said housing being fixedly attached to said first end of said dampener, and;

a cord defining a first end and a second end, said first end of said cord being attached to said second end of said dampener, said second end of said cord being adapted to be pivotally attached to the second ladder such that when the stair structure is collapsed, said dampener and said cord limit free extension of said stair structure and when the stair structure is extended, said dampener and said cord limit the collapse of the stair structure and;

a pivoting guide proximate said second end of said housing, said pivoting guide being adapted to receive said cord and to allow said cord, as said dampener extends and retracts, to extend at an angle canted to said longitudinal dimension of said housing.

* * * * *